US006461020B2

(12) United States Patent
Horikawa

(10) Patent No.: US 6,461,020 B2
(45) Date of Patent: Oct. 8, 2002

(54) REFLECTOR FOR A HIGH PRESSURE DISCHARGE LAMP DEVICE

(75) Inventor: Yoshihiro Horikawa, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/934,592

(22) Filed: Aug. 23, 2001

(65) Prior Publication Data

US 2002/0024811 A1 Feb. 28, 2002

(30) Foreign Application Priority Data

Aug. 28, 2000 (JP) ..... 2000-256721

(51) Int. Cl.[7] ..... F21K 27/00

(52) U.S. Cl. ..... 362/264; 362/294; 362/373; 362/345; 313/113

(58) Field of Search ..... 362/345, 294, 362/373, 218, 264; 313/113, 114, 639, 642

(56) References Cited

U.S. PATENT DOCUMENTS 5,109,181 A 4/1992 Fischer et al.
5,177,396 A * 1/1993 Gielen et al. ..... 313/113
5,281,889 A * 1/1994 Fields et al. ..... 313/113
5,497,049 A 3/1996 Fischer
6,060,830 A * 5/2000 Sugitani et al. ..... 313/639
6,274,983 B1 * 8/2001 Ooyama et al. ..... 313/632

* cited by examiner

*Primary Examiner*—Laura K. Tso
*Assistant Examiner*—Ronald E. Del Gizzi
(74) *Attorney, Agent, or Firm*—Nixon Peabody LLP; David S. Safran

(57) ABSTRACT

A reflector for a high pressure discharge lamp device including a metallic component such that when the lamp is damaged the reflector is not broken or when the reflector is broken, spraying of lamp fragments can be effectively prevented. In the reflector for a high pressure discharge lamp device, the glass reflector houses a discharge lamp of the short arc type in which the discharge vessel is filled with greater than or equal to 0.15 mg/mm$^3$ of mercury, the outside surface of the glass reflector is surrounded by a metallic component.

5 Claims, 2 Drawing Sheets

REFLECTOR FOR A HIGH PRESSURE DISCHARGE LAMP DEVICE

BACKGROUND OF THE INVENTION

1. Field of the Invention

The present invention relates to a high pressure discharge lamp device with a discharge lamp of the short arc type which is used for a light source of a data projector or the like. The invention relates especially to a reflector of a high pressure discharge lamp device with a superhigh pressure mercury lamp of the short arc type in which the discharge vessel is filled with greater than or equal to 0.15 mg/mm$^3$ of mercury.

2. Background of the Invention

For a light source for projection of data in a projector or the like, there is a need for high illuminance and good color reproduction. Furthermore size reduction of the devices is often desired. In order to meet this demand, superhigh pressure short arc mercury lamps are being used more and more in which the discharge vessel is filled with greater than or equal to 0.15 mg/mm$^3$ of mercury.

However, this type of lamp has a high operating pressure. When the lamps are damaged the problem is in the worst case that lamp fragments spray. Especially for a reflector which is used for a high pressure discharge lamp device with one such lamp a glass component is used with an inside which has been coated with a dielectric multilayer film in order to reflect the light of the lamp with high efficiency. Therefore the problem is that at the same time the lamp is damaged the glass reflector shatters and portions of the glass reflector may fly around.

As a countermeasure against this spraying of lamp fragments the thickness of the glass reflector is conventionally increased, its strength is increased and furthermore a front glass is put in place so that the interior of the reflector has been essentially hermetically enclosed and the spraying of the lamp fragments and the like has been prevented. When the thickness of the glass reflector is increased, the disadvantage however arises that during lamp operation thermal distortion forms and the mechanical strength of the reflector itself is reduced, because the outside of the reflector is cooled and its inside is heated and therefore the temperature difference between the inside and outside becomes large. When for example within an oval reflector of borosilicate glass with a focal length f of less than or equal to 12 mm and a thickness of greater than or equal to 4 mm there is the above described lamp with an input electric power of greater than or equal to 150 W and it is operated at least 1000 hours, in this reflector as a result of the above described thermal distortion there is a high probability that cracks will occur. It was furthermore found that in the case of damage to the lamp it is highly probable that the reflector is also damaged.

As a countermeasure against this spraying of the lamp fragments and the like in the case of lamp damage, a reflector of metal has been used. A metallic reflector in itself however has a low reflectivity. If an attempt is made to coat the metallic reflector with a dielectric multilayer film, as is used for a glass reflector in order to obtain a stipulated reflectivity, the metal surface cannot be directly coated with the dielectric multilayer film. Therefore an intermediate layer of resin or the like must be placed between the dielectric multilayer film and the metallic reflector. This intermediate layer however has very low thermal resistance. Finally, there is the disadvantage that it is difficult to use a metallic reflector.

SUMMARY OF THE INVENTION

An object of the present invention is to devise a reflector for a high pressure discharge lamp device in which the reflector is not shattered, or in which when the reflector is broken spraying of the lamp fragments can be prevented with certainty, without increasing the reflector thickness in order to prevent the spraying of the lamp fragments and the like in case of lamp damage.

In accordance with a first aspect of the invention, a reflector for a high pressure discharge lamp device includes a glass reflector wherein there is a discharge lamp of the short arc type in which the discharge vessel is filled with greater than or equal to 0.15 mg/mm$^3$ mercury, and the outside surface of this glass reflector is surrounded with a metal component.

In a further development of the invention the above described metallic component includes is at least one cooling rib.

In the following, the invention is further described using several embodiments shown in the drawings.

BRIEF DESCRIPTION OF THE DRAWINGS

FIG. 2(*b*) shows a rear view of the reflector for a high pressure discharge lamp device.

DETAILED DESCRIPTION OF THE INVENTION

The invention is described below referring to the first embodiment shown in FIG. 1.

Figure 1:
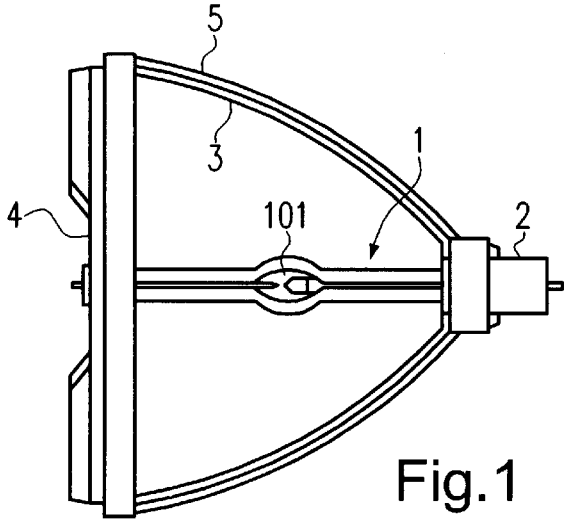
FIG. 1 shows a side view of the arrangement of a reflector for a high pressure discharge lamp device according to a first embodiment of the invention in a partial cross section within which there is a superhigh pressure mercury lamp of the short arc type.

FIG. 1 shows a side view of the arrangement of a reflector for a high pressure discharge lamp device according to a first embodiment of the invention shown in a partial cross section within which there is a superhigh pressure mercury lamp of the short arc type. In the figure, reference number 1 labels the superhigh pressure mercury lamp of the short arc type with an input electric power of greater than or equal to 50 W, for example from 150 W to 400 W. Its discharge vessel 101 has a spatial volume of greater than or equal to 50 mm$^3$. The discharge vessel 101 is filled with greater than or equal to 0.15 mg/mm$^3$ mercury. Furthermore, reference number 2 labels the base of the lamp 1, reference number 3 labels a glass reflector of borosilicate glass in which the thickness of the reflector part is less than or equal to 5 mm, for example, 2.5 mm, reference number 4 labels a front glass, and reference number 5 labels a metallic component of aluminum (Al) with a thickness of roughly 1 mm which has been produced by pressing.

This metallic component can furthermore be produced by casting, machining, cutting out of a block or the like, or it can also be a metal net or the like so long as it can prevent spraying of the reflector fragments. Instead of aluminum any other suitable metal can be used.

As shown in the drawings, within the glass reflector 3 there is the superhigh pressure mercury lamp 1 of the short arc type. On the outside of the glass reflector 3 there is the metallic component 5 to jacket the glass reflector 3.

During stationary luminous operation the emission light from the lamp 1 is reflected by the inside of the glass reflector 3, passes through the front glass 4 and is emitted forward.

Even if it is assumed that in stationary luminous operation the lamp 1 is damaged, the lamp fragments collide with the glass reflector 3 and the reflector is broken, the lamp fragments or the reflector fragments are shielded by the metallic component 5 which jackets the glass reflector 3, preventing their spraying from the metallic component 5 to the outside. The front glass 4 can furthermore be made relatively thick compared to the glass reflector 3. Spraying from the lamp 1 in the forward direction when the lamp is damaged is therefore prevented by the front glass 4.

In this embodiment of the invention, spraying of the fragments can be prevented by the metallic component 5 in this way even if in the worst case the lamp 1 during luminous operation is damaged and furthermore the glass reflector 3 is shattered by the lamp fragments. Since the metallic component 5 has the function of preventing the spraying of the glass pieces, the thickness of the reflector part of the glass reflector 3 can be relatively reduced and thus the weight of the high pressure discharge lamp device can be reduced overall. At the same time, it becomes possible to reduce the thickness of the glass reflector 3 compared to that of a conventional reflector. Therefore the emission of the heat from the metallic component 5 can be increased.

Figure 2A:
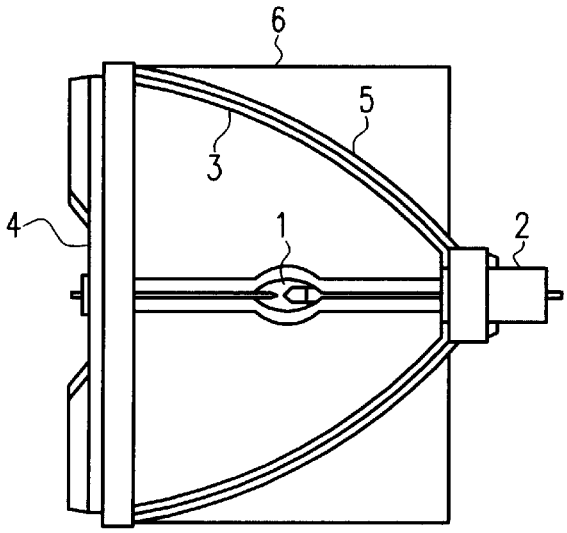
FIG. 2(*a*) shows a side view of the arrangement of a reflector for a high pressure discharge lamp device according to a second embodiment of the invention in a partial cross section within which there is a superhigh pressure mercury lamp of the short arc type.
Figure 2B:
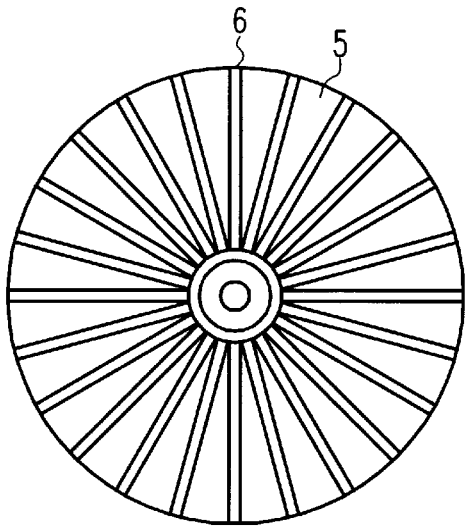

The invention is further described below using the second embodiment shown in FIG. 2. FIG. 2(*a*) shows a side view of the arrangement of a reflector for the high pressure discharge lamp device according to this embodiment of the invention in a partial cross section, within which there is a superhigh pressure mercury lamp of the short arc type. FIG. 2(*b*) shows a rear view of the reflector for a high pressure discharge lamp device.

In FIG. 2(*a*) and FIG. 2(*b*) a cooling rib 6 is located in the metallic component 5. The remaining arrangement here is identical to FIG. 1 and is provided with the same reference numbers.

As shown in FIG. 2(*a*) and FIG. 2(*b*), the heat which forms in the glass reflector 3 can be effectively emitted by the cooling ribs 6 by the arrangement of the cooling ribs 6 in the metallic component 5. Therefore the cooling action of the lamp in itself and of the reflector can be increased. The arrangement of the cooling ribs 6 obviates the necessity of a cooling fan. Therefore a smaller and lighter high pressure discharge lamp device can be obtained.

One example of a test forced fracture circuit is shown below in FIG. 3. It is used to confirm the effect of the reflector for a high pressure discharge lamp device according to the above described respective embodiments of the invention.

Figure 3:
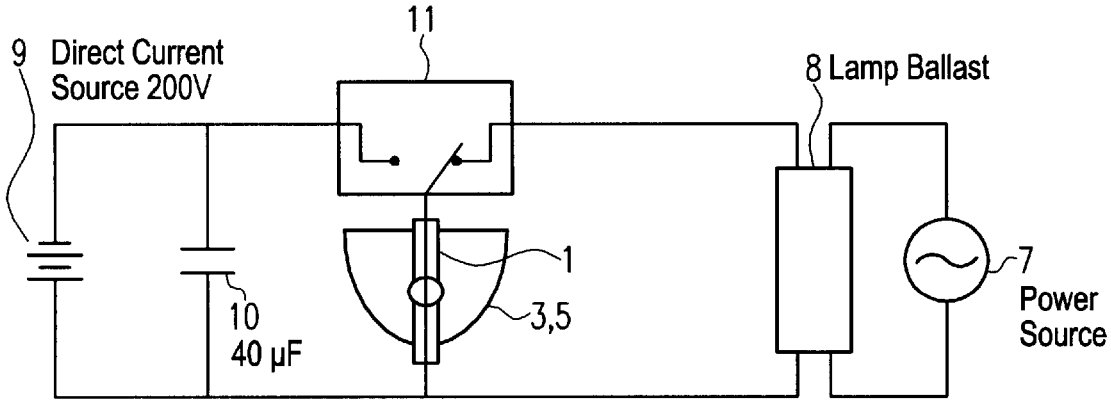
FIG. 3 shows a schematic of one example of a test forced fracture circuit which is used for confirmation of the effect of the reflector for a high pressure discharge lamp device according to the respective embodiment of the invention.

In FIG. 3 reference number 7 labels a current source, reference number 8 a lamp ballast of a high pressure discharge lamp device, reference number 9 a direct current source, reference number 10 a capacitor for discharge and reference number 11 a changeover device for changeover of a switch which consists of a rely or a semiconductor component or the like. The other parts are provided with the same reference numbers as in FIG. 1.

This test of the high pressure discharge lamp device by the test forced fracture circuit was carried out as follows:

First, the switch of the changeover device 11 is switched to the side of the lamp ballast 8 and the lamp 1 is shifted into the stationary luminous operating state. On the other hand, the capacitor is charged for a discharge 10 by the direct current source 9. With respect to the lamp 1 which is in stationary luminous operating state the switch of the changeover device 11 is switched to the side of the capacitor for a discharge 10; its voltage is forced upon the lamp 1. Thus, a discharge takes place. The lamp can be artificially broken by an acute discharge of the capacitor 10.

The action of the reflector for a high pressure discharge lamp device according to the above described embodiment can be easily confirmed by various tests using one such test forced fracture circuit.

In the invention it is possible to prevent the spraying of fragments from the metallic component to the outside even if the superhigh pressure mercury lamp of the short arc type breaks and the glass reflector has been shattered by the lamp fragments, Since the metallic component is intended to prevent spraying of the glass pieces, the thickness of the reflection part of the glass reflector can be somewhat reduced and the weight of the high pressure discharge lamp device can be reduced overall. Furthermore, it becomes possible to reduce the thickness of the glass reflector compared to conventional reflectors. Therefore the emission of the heat from the metallic component can be increased.

With a further development of the described invention, the heat which forms in the glass reflector can be effectively emitted by the cooling ribs. Therefore the cooling action of the lamp itself and of the reflector can be increased. Thus it is no longer necessary to mount a cooling fan, and a smaller and lighter high pressure discharge lamp device can be obtained.

What we claim is:

1. A reflector for a high pressure discharge lamp device, comprising a glass reflector for housing a short arc discharge lamp having a discharge vessel filled with at least 0.15 $mg/mm^3$ of mercury; and a metallic component surrounding an outside surface of said glass reflector.

2. The reflector for a high pressure discharge lamp device as claimed in claim 1, further comprising at least one cooling rib formed in the metallic component.

3. The reflector for a high pressure discharge lamp device as claimed in claim 2, wherein said at least one cooling rib has a form of an arch extending over the outside surface of the metallic component.

4. The reflector for a high pressure discharge lamp device as claimed in claim 2, wherein the metallic component has a plurality of cooling ribs extending radially over the outside surface of the glass reflector.

5. The reflector for a high pressure discharge lamp device as claimed in claim 3, wherein the metallic component has a plurality of cooling ribs extending radially over the outside surface of the glass reflector.

* * * * *